United States Patent [19]

Ohnmacht et al.

[11] 4,361,954

[45] Dec. 7, 1982

[54] METHOD OF AND APPARATUS FOR THE PRODUCTION OF A TOASTER HEATING ELEMENT

[75] Inventors: Helmut Ohnmacht, Kandel; Edwin Höfer, Bellheim, both of Fed. Rep. of Germany

[73] Assignee: Firma Fritz Eichenauer, Kandel, Fed. Rep. of Germany

[21] Appl. No.: 146,162

[22] Filed: May 2, 1980

[30] Foreign Application Priority Data

May 3, 1979 [DE] Fed. Rep. of Germany ..... 2917808

[51] Int. Cl.[3] ..... H05B 3/00

[52] U.S. Cl. ..... 29/611; 219/521; 99/389

[58] Field of Search ..... 219/521, 523, 536, 537; 99/385, 389; 29/611

[56] References Cited

U.S. PATENT DOCUMENTS 1,394,856 10/1921 Mendels ..... 219/521 X 2,747,072 5/1956 Lawser ..... 99/389 X

*Primary Examiner*—Leon Gilden

*Attorney, Agent, or Firm*—Antonelli, Terry & Wands

[57] ABSTRACT

In a method for the production of toaster heating elements firstly connecting strips made of electrically conductive material are arranged in the region of edge recesses at opposite edges at the rear side of a support plate, opposite to the heating side. Then a plurality of heating conductor wires are provided substantially parallel to one another and in such a way that they cross the connecting strips in the region of the edge recesses at the heating side and thereby are electrically connected to said strips. Furtheron the wires are cut off. In an apparatus for performing the method there is provided a processing station comprising a supporting surface for the support plate of the heating elements. The processing station further comprises housing grooves one for each connecting strips. Said grooves are situated at opposite side edge regions of the supporting surface. Further a delivery station associated with the processing station is provided. The delivery station comprises a plurality of supply reels for the heating conductor wires to be arranged on the support plate. A connecting device forms an electrically conductive connection between the heating conductor wires and the connecting strips. A severing device cuts for the heating conductor wires.

18 Claims, 4 Drawing Figures

METHOD OF AND APPARATUS FOR THE PRODUCTION OF A TOASTER HEATING ELEMENT

Figure 1:
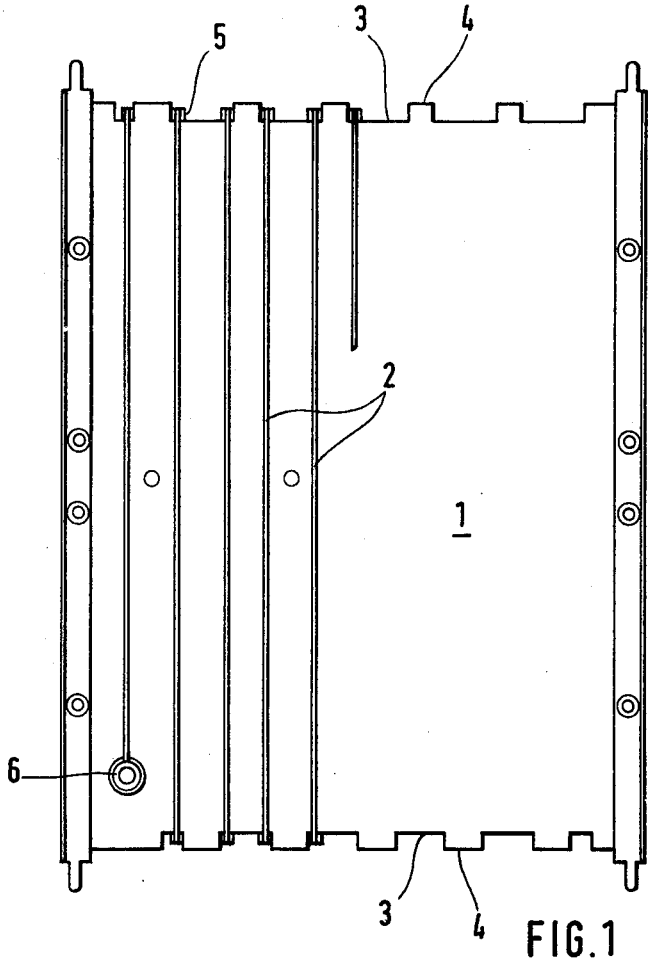

The invention relates to a method for the production of a toaster heating element comprising a heating conductor wire and a support plate provided with edge recesses at opposite edges, the heating conductor wire extending substantially over one heating side of the support plate. The invention also relates to an apparatus for carrying out such a method.

Toasters usually have two different types of heating element. Between the two toasting slots which are usually provided there is situated a heating element which is wound on both sides and the production of which presents no particular difficulty since the heating conductor wire can be wound in a simple manner about the insulating support plate. At the outer sides of the toasting slots, on the other hand, heating elements are provided which give off heat only at one side, which faces towards the respective neighbouring toasting slot and is referred to hereinafter as the heating side, and consequently are only provided with heating conductor wire at this side.

To manufacture such toaster heating elements wound at one side, usually first of all the support plate made of insulating material is provided with edge recesses, between which corresponding projections remain standing. The heating conductor wire is looped about the projections and as a result is disposed substantially only at the heating side of the support plate. It is situated at the rear side only in the regions where the heating conductor wire is looped about the projections standing between the edge recesses. The ends of the heating conductor wire are attached in conventional manner to the support plate and provided with connection elements.

The manufacture of such unilaterally wound toaster heating elements requires movement patterns which cannot very well be carried out with machines, or at any rate not with an economically acceptable outlay. For this reason these heating elements of the type discussed hereinbefore are in practice produced by manual work. This involves much time and expense. Also, this known procedure gives unsatisfactory results. The complicated pattern of movement required during winding makes it practically impossible to maintain a uniform tension in the heating conductor wire, so that in practical use the heating conductor wire often works loose subsequently due to the action of the operational heat occurring at the heating conductor wire. It is also difficult to avoid damage being caused during winding to the support plates, which usually consist of easily breakable insulating material such as synthetic mica or the like, more especially in the region of the projections remaining between the edge recesses.

The invention has as its object to provide a method whereby toaster heating elements of the type described initially can be produced in a simple and economically advantageous manner and in such a way as to be of high and uniform quality. At the same time an object of the invention is to provide an apparatus suitable for carrying out such a method.

As regards method, this object is achieved in that at the rear side of the support plate, opposite from the heating side, there are arranged in the region of the edge recesses connecting strips made of electrically conductive material, that a plurality of heating conductor wires are arranged substantially parallel to one another and crossing the connecting strips in the region of the edge recesses at the heating side, are connected electrically to the connecting strips, and then cut off. Thus, according to the present invention, instead of a single heating conductor wire being wound continuously about the support plate a plurality of heating conductor wires parallel to one another are arranged at one side of the plate, and, crossing said wires in the plate edge regions, connecting strips are arranged at the back side of the plate, and these are connected together. The connection can be effected in various ways, including by bending or pinching, but is preferably effected by spot welding. In every case the connection points are situated in the region of the edge recesses. To achieve a definite fixing of the heating conductor wires it is recommended that these be disposed in the region of the edge recesses but directly at the boundaries of the recesses, so that the projections situated between the recesses are enclosed between adjacent connection points with as little clearance as possible. The heating conductor wires can consist in the usual way of resistance wire of round or rectangular cross-section. The connecting strips preferably consist of sheet metal strips of a relatively considerable width in relation to the cross-section of the heating conductor wires. The pattern of movements necessary for carrying out the described method is composed exclusively of simple rectilinear movements, so that complicated and time-consuming winding operations are avoided.

The method described hereinbefore produces a heating element wherein all the heating conductor wires are connected in parallel with one another by the connecting strips. That may be very advantageous in many cases. But mostly it will be advantageous to have the heating conductor wires connected in series, for adaptation to the given working voltage of the toaster. This can be achieved in a simple way by severing the connecting strips in the region of the edge recesses between the connection points with the heating conductor wires. In every case there is the advantageous possibility of producing the connecting strips from material which is a good conductor of electricity-in contrast to the heating conductor wires. Thus the thermal energy released at the rear side of the heating element is reduced to a minimum.

In carrying out the described method in actual practice it is recommended that first of all the connecting strips should be arranged on a rest or backing at preset intervals, then the support plate is laid with its rear side on to the connecting strips, and finally the heating conductor wires are drawn off supply reels, one reel for each wire, and applied to the heating side of the support plate. It is also readily possible to ensure that the heating conductor wires are under a predetermined mechanical tension, for example by suitable braking of the supply reels when wire is drawn off, or by using a suitable tensioning apparatus such as for example an apparatus in the form of spring-loaded or weight-loaded guide rollers.

The connecting strips may be arranged on the support plate in the form of separate sections of predetermined length. Another possibility is for the connecting strips also to be drawn off each from its own supply reel, in a direction at right angles to the direction of the heating conductor wires, and to be cut to their intended length after connection to the heating conductor wires.

In every case it can be ensured that the heating conductor wires and connecting strips have definite locations on the support plate, proof against subsequent loosening, by providing the connecting strips with a deformation in the form of bent-over or offset portions engaging in the edge recesses. This kind of deformation can be produced in a preparatory operation before the arrangement of the connecting strips at the support plate. It is also possible with advantage for the deformation to be effected when producing the connections with the heating conductor wires. For securing the heating conductor wires and connecting strips at the support plate the heating conductor wires may also be bent into the edge recesses, preferably also at the time the electrical connection with the connecting strips is made, for instance by means of the spot welding tools.

As regards apparatus, the object aimed at by the invention is achieved with an apparatus for carrying the method described hereinbefore into effect which is characterised by a processing station with a supporting surface for the support plate and with housing grooves one for each connecting strip, said grooves being arranged at opposite edge regions of the supporting surface, by a delivery station associated with the processing station and having a plurality of supply reels for the heating conductor wire, by a connecting device for producing an electrical connection between the heating conductor wires and the connecting strips, and by a severing device for the heating conductor wires. The processing station with supporting surface for the support plate and housing grooves for the connecting strips makes it possible to arrange the support plate and the connecting strips definitely fixed in predetermined positions relatively to one another. Then the heating conductor wires are drawn to the requisite length from the supply reels and over the support plate electrically connected by means of the connecting device to the connecting strips at the places where they cross with the said strips, and then severed. The remaining operations such as for example the application of a holding strip of insulating material or the attaching of terminal or connecting ends of the heating conductor wires are carried out in the usual way and need not be described here.

In a particularly preferred construction form the connecting device comprises respective rails or bars, each of which is arranged to be liftable and lowerable over the housing groove and is provided with a plurality of spot welding electrodes. It is advantageously possible at the same time to construct the bars or spot welding electrodes on the one hand and the bottoms of the respective associated housing grooves on the other hand as deforming tools for the deforming or bending of the connecting strips and/or the heating conductor wires. It is also possible to provide the bar in the region of the edge recesses of the support plate with punching tools for severing the connecting strips. Of course the housing grooves are provided at the groove bottoms with suitable apertures for the punching tools. The connecting, deforming and severing operations or functions can thus be combined to a very considerable extent. The punching tools are preferably guided in the bar and bear thereon by means of spring force, the bar being adjusted indirectly through the punching tools. After connecting strips, support plate and heating conductor wires have been suitably arranged, the bar is lowered and pressed against heating conductor wires and connecting strips in accordance with the spring force present between it and the punching tools, deformation being carried out if appropriate as this occurs. Then the connecting work is carried out at the crossing points, for instance by spot welding, and finally the punching tools are moved further downwards in opposition to the spring force, whereat the connecting strips are severed. The contour of the bar is of course made such that the support plate itself, or the projections between the edge recesses, are not subjected to the action of any substantial forces.

Considered in the direction of travel of the heating conductor wires, the severing device is advantageously situated after the processing station so that, when a heating element is removed after it has been completed, the heating conductor wires for the production of a further heating element are drawn over the processing station and only severed thereafter. In order to ensure definite location of the heating conductor wires it is advantageous to arrange between delivery station and processing station a guide element for the heating conductor wires, which may consist for example of a guide beam, parallel to the housing groove, and having passages or apertures each for one heating conductor wire, said apertures being situated at predetermined intervals.

The processing station is preferably arranged at the upper side of a liftable and lowerable table. After a heating element is completed the table is moved downwards and the connecting strips and support plate for the next production operation are put on, whilst at the same time the completed heating element is removed and the heating conductor wires for the next production operation are drawn over the processing station. Then the table is moved upwards again and the connections between connecting strips and heating conductor wires are executed in the way described hereinbefore. As explained, the connecting strips can be either introduced as separate sections, possibly already suitably deformed, or likewise drawn off from supply reels and each severed.

Figure 2:
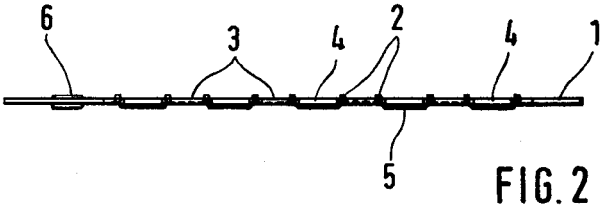
Figure 3:
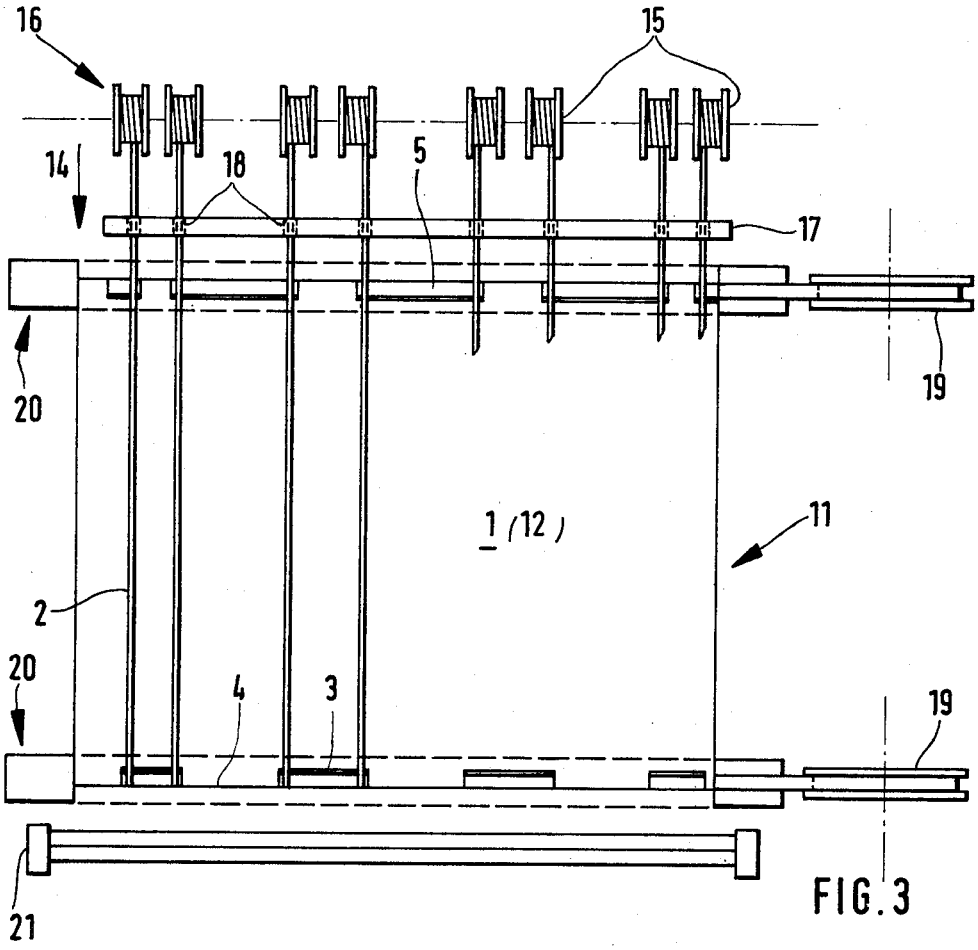
Figure 4:
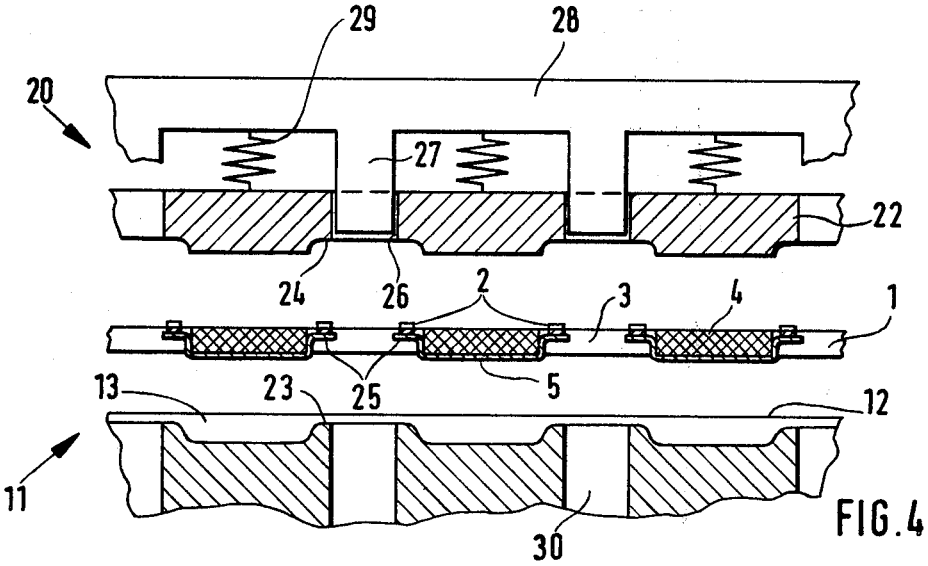

The invention will be explained in detail hereinafter with the use of drawings which show simply an example of embodiment, and wherein:

FIG. 1 shows a view in elevation of a toaster heating element provided at one side with heating conductor wire, FIG. 2 shows the subject of FIG. 1 in an end-on view, FIG. 3 shows an apparatus for producing a toaster heating element according to FIG. 1 diagrammatically and in elevation, FIG. 4 shows a detail of the subject of FIG. 3 in cross-section, on a larger scale.

The toaster heating element shown in FIG. 1 comprises substantially a support plate 1 of synthetic mica and a plurality of heating conductor wires 2 which are parallel to one another and which are disposed at one side, namely the heating side of the support plate 1, which is that illustrated. The support plate comprises at two edges situated opposite one another edge recesses 3 which are spaced from one another by projections 4. In the region of the edge recesses 3, connecting strips 5 are disposed at the edges of the support plate 1, at the rear of the said plate. Whereas the heating conductor wires 2 consist of conventional resistance material, in the illustrated constructional example the connecting strips 5 are made of electrically readily conductive material, for example copper. In the region of each edge recess 3, two heating conductor wires 2 in each case extend over the support plate 1, and in fact in such a manner that in each case they cross the connecting strips 5 immediately adjacent one of the projections 4. At the crossing points the heating conductor wires 2 and the connecting strips 5 are connected to one another by spot welding. Of the connecting strips 5 only the regions situated below the projections 4 are retained, whilst the regions of the connecting strips 5 which are shown in FIG. 2 in broken lines and are situated in the edge recesses 3 are punched out. As FIG. 1 also shows, the edge recesses 3 are arranged offset relatively to one another at the two edges. This gives rise to series connection of the heating conductor wires 2 and the remaining sections of the connecting strips 5. The ends of the first and last heating conductor wire 2 are eyeletted at the connection points 6 to the support plate 1.

The end view of the heating element shown in FIG. 2 shows that the connecting strips 5 have offset portions projecting into the edge recesses 3, and are thereby secured against lateral displacement relatively to the projections 4. At the same time the heating conductor wires 2 are also bent at their end regions into the edge recesses 3.

The apparatus shown in FIG. 3 for the purpose of producing the toaster heating element discussed hereinbefore comprises in the first instance a processing station 11 wherein the support plate 1, heating conductor wires 2 and connecting strips 5 are connected to one another. The processing station 11 comprises substantially a supporting surface 12 for the particular support plate 1 being processed, and housing grooves 13 disposed in the region of the edge regions of the support plate 1 which are provided with the edge recesses 3, said grooves being provided for a connecting strip 5 each. The heating conductor wires 2 are fed to the processing station 11 in the direction of through travel indicated by an arrow 14 from supply reels 15 which are grouped in a delivery station 16 and in the illustrated constructional example are arranged coaxially with axes parallel to the housing grooves 13. Situated between the processing station 11 and the delivery station 16 is a guide element 17 which comprises a guide beam which is parallel to the housing grooves 13 and is provided at predetermined intervals corresponding to the arrangement of heating conductor wires 2 on the support plate 1 with apertures 18 through each of which a heating conductor wire 2 is guided. The housing grooves 13 are in each case fed, in a direction at right angles to the direction of travel 14, with a connecting strip 5, each strip from a supply reel 19. At the crossing points, situated in the region of the two housing grooves 13, heating conductor wires 2 and connecting strips 5 are connected to one another by spot welding by means of a connecting device 20. This will be explained in detail hereinafter with reference to FIG. 4. After the connection has been produced, the support plate 1 is removed from the supporting surface 12 in the direction of travel 14, and heating conductor wires 2 are drawn from the supply reels 15 to a length necessary for the next production operation or cycle. Then the heating conductor wires 2 are severed, at the heating element which has just been completed, by means of the severing device 21 which is situated downstream of the processing station 11 in the direction of travel 14.

The connecting device 20 comprises substantially two bars 22 which are situated over the corresponding housing groove 13 in each case and of which one is shown in section in FIG. 4. The Figure shows one above the other, in positions moved apart from one another, the processing station 11 with a housing groove 13, above it a support plate 1 with heating conductor wires 2 and connecting strips 5, and also, thereabove, the liftable and lowerable bar 22. In the region of the edge recesses 3 the bottom of the housing groove 13 comprises projections 23 and the bar 22 comprises depressions 24, so that the bar 22 and the bottom of the housing groove 13 together constitute a deforming tool for forming on the connecting strip 5 offsets 25 which engage in the edge recesses 3. The regions of the bar 22 which adjoin the heating conductor wires 2 in the brought-together state at the same time form spot welding electrodes with which heating conductor wires 2 and connecting strips 5 are electrically connected. Moreover FIG. 4 also indicates how the heating conductor wires 2 are bent into the edge recesses 3. In the regions corresponding to the edge recesses 3 of the support plate 1 the bar 22 has openings 26 in which punching tools 27 are guided with which the connecting strip 5 is in each case severed between the two heating conductor wires 2 situated in an edge recess 3. The punching tools 27 are secured to a beam 28 which is arranged above and which bears on the bar 22 by means of springs 29—which are only shown schematically in the illustration. Apertures 30 for the punching tools 27 are provided in the bottom of the housing groove 13.

The apparatus described hereinbefore operates in the following way: After completion of a heating element the processing station 11 arranged on a liftable and lowerable table is moved downwardly. The connecting strips are drawn off the supply reels 19 and introduced into the housing grooves 13. Then a support plate 1 is inserted in the processing station 11 and thereupon the processing station 11 is moved upwards until the heating conductor wires 2 which, at the conclusion of the preceding production operation had been drawn over the processing station 11, are adjacent the heating side of the support plate 1. Then the bar is moved downwardly by the action of force on the beam 28, until the connecting strip 5 is deformed in the manner explained, and at the same time bears firmly on the heating conductor wires 2. Then with a pulse of current the heating conductor wires 2 and the connecting strips 5 are spot-welded to one another. By further action of force the beam 28 is further moved downwardly in opposition to the action of the springs 29, until the punching tools 27 sever the connecting strips between each two heating conductor wires of an edge recess 3. Then the bar 22 and beam 28 are moved upwards again, and the substantially completed heating element is removed from the processing station 11, the heating conductor wires 2 for the next production operation being drawn off from the supply reels 15, and finally the heating conductor wires 2 are severed with the severing device 21. Preferably there is connected to the severing device 21 a clamping device (not shown) which holds the heating conductor wires 2 securely in their stretched-out position. The securing of the heating conductor wires 2 at the connection points 6 of the support plate 1 is carried out in a subsequent working stage, which need not be discussed here.

We claim:

1. Method for the production of a toaster heating element comprising a heating conductor wire and a support plate provided with edge recesses at opposite edges, the heating conductor wire being disposed substantially over a front, heating side of the support plate, comprising the steps of arranging connecting strips of electrically conductive material at a rear side of the support plate (1), which is opposite the heating side, so that each strip extends fully across a dimension of the support plate in the region of the edge recesses (3) of a respective one of said opposite edges, arranging a plurality of heating conductor wires (2) substantially parallel to one another each of the conductor wires crossing the connecting strips (5) in the region of an oppositely located pair of the edge recesses (3) at the heating side, electrically connecting said conductor wires to the connecting strips (5), and then cutting said conducting wires to form discrete conductive lengths.

2. Method according to claim 1, characterised in that the connecting strips (5) are severed in the region of the edge recesses (3) between the connecting points with the heating conductor wires (2).

3. Method according to one of claims 1 or 2, characterised in that the connecting strips (5) are arranged on a backing at predetermined intervals, the support plate (1) is placed with its rear side on to the connecting strips (5), and the heating conductor wires (2) are drawn off each from a supply reel (15) and laid on the heating side of the support plate (1).

4. Method according to claim 1, characterized in that, during the connecting strip arranging step, the connecting strips (5) are arranged on a backing at predetermined invervals, the support plate (1) is placed with its rear side on to the connecting strips (5) in a following step, and then the heating conductor wires (2) are each drawn off from a supply reel (15) and laid on the heating side of the support plate (1) during said step of arranging the conductor wires.

5. Method according to one of claims 1 or 2 or 4, comprising the further step of providing the connecting strips (5) with a deformation (25) in the form of offset portions engaging in the edge recesses (3).

6. Method according to claim 5, characterized in that the step wherein the connecting strips (5) are provided with the deformation (25) is performed at the time that connections of the connector strips with the heating conductor wires (2) are produced.

7. Method according to one of claims 1 or 2 or 4, characterized in that the step of connecting said conductor wires to said connecting strips includes the step of bending the heating conductor wires (2) into the edge recesses (3) at the time of their connection to the connecting strip (5).

8. Method according to one of claims 1 or 2, or 4, characterised in that the connecting strips (5) are each drawn off from a supply reel (19) in a direction at right angles to the direction of the heating conductor wires (2), and, after connection to the heating conductor wires (2), are cut to their predetermined length.

9. Method according to claim 8, comprising the further step of providing the connecting strips (5) with a deformation (25) in the form of offset portions engaging in the edge recesses (3).

10. Method according to claim 1, characterized in that, during the step of arranging the connecting strips, the connecting strips (5) are each drawn off from a supply reel (19) in a direction at right angles to the direction of the heating conductor wires (2), and, after connection to the heating conductor wires (2), are cut to their predetermined length.

11. Method according to claim 10, comprising the further step of providing the connecting strips (5) with a deformation (25) in the form of offset portions engaging in the edge recesses (3).

12. Method according to claim 6, characterized in that the step of connecting said conductor wires to said connecting strips includes the step of bending the heating conductor wires (2) into the edge recesses (3) at the time of their connection to the connecting strips (5).

13. Method according to claim 1, comprising the step of supporting the support plate in a processing station having a supporting surface for the support plate and with housing grooves, one for each connecting strip, said grooves being situated at opposite edge regions of the supporting surface, wherein said heating conducting wires are supplied by a plurality of supply reels during the conducting wire arranging step; wherein said electrically connecting step is formed by a connecting device; and wherein said severing step is performed by a severing device.

14. Method according to claim 1, wherein the conductor wires are directly connected to said connecting strips during the connecting step.

15. Method according to claim 14, wherein the direct connection is formed by spot welding.

16. Method according to claim 14, wherein the direct connection is formed by plastic deformation.

17. Method according to claim 1 or 13, wherein the step of arranging said conductor wires is performed with the conductor wires being held under a predetermined mechanical tension.

18. Method according to claim 2, wherein the step of severing the connecting strips is performed so as to create a heating element wherein the conductor wires are connected to portions of said connector strips in an alternating series.

* * * * *